United States Patent [19]

Steers et al.

[11] Patent Number: 4,870,234

[45] Date of Patent: Sep. 26, 1989

[54] MICROWAVE OVEN COMPRISING A DEFROSTING DETECTOR

[75] Inventors: Michel Steers, La Queue-En-Brie; Jean-Pierre Hazan, Sucy-En-Brie; Gilles Delmas, Paris, all of France

[73] Assignee: U.S. Philips Corporation, New York, N.Y.

[21] Appl. No.: 258,355

[22] Filed: Oct. 17, 1988

[30] Foreign Application Priority Data

Oct. 20, 1987 [FR] France ..... 87 14442

[51] Int. Cl.[4] ..... H05B 6/68

[52] U.S. Cl. ..... 219/10.55 B; 219/10.55 E; 374/149

[58] Field of Search ..... 219/10.55 B, 10.55 R, 219/10.55 E, 10.55 F, 10.55 M, 504, 505; 338/22 R; 374/149; 99/DIG. 14, 451, 325; 340/588, 589

[56] References Cited

U.S. PATENT DOCUMENTS

| | | | |
|---|---|---|---|
| 3,527,915 | 9/1970 | Haagensen et al. | 219/10.55 B |
| 4,093,841 | 6/1978 | Dills | 219/10.55 B |
| 4,162,381 | 7/1979 | Buck | 219/10.55 B |
| 4,341,937 | 7/1982 | Staats | 219/10.55 M |

FOREIGN PATENT DOCUMENTS 2571830 4/1986 France .

*Primary Examiner*—Philip H. Leung
*Attorney, Agent, or Firm*—Algy Tamoshunas; Leroy Eason

[57] ABSTRACT

A microwave oven which includes a defrosting detector in the oven cavity in the proximity of a frozen product to be defrosted, the detector including a material which absorbs microwave energy, the absorption of microwave energy by the detector and by the product causing their temperatures to rise. Variations in the detector temperature are measured by a measuring element producing an electrical signal corresponding thereto, such signal being used to control the defrosting process. The microwave absorbent material is in the form of a layer deposited on a carrier which is positioned behind the product so that most of the detector area can only receive microwave energy through the product, whereby the rate of change of detector temperature with time decreases as the product defrosts and becomes constant when defrosting has been completed. The carrier may be one of the walls of the oven cavity or the oven tray. The material may be a resistive ink deposited on the oven tray by screen-process printing.

9 Claims, 3 Drawing Sheets

MICROWAVE OVEN COMPRISING A DEFROSTING DETECTOR

BACKGROUND OF THE INVENTION

1. Field of the Invention

The invention relates to a microwave oven comprising a microwave source and defrosting detector arranged in the oven in the proximity of a product to be processed, the detector comprising a material which absorbs microwave energy, the absorption of microwave energy by the detector and by the product causing their temperatures to rise, the detector temperature being measured by means of a measuring element.

2. Description of the Related Art

Currently microwave ovens are often used for defrosting and re-heating foodstufs which have been previously kept in a freezer. In general, this defrosting is effected empirically: the user determines the approximate weight of the food to be defrosted in order to derive an approximate operating time for the microwave oven. This results in more or less complete defrosting or even a beginning of cooking. It is also known from the literature that around 2.45 GHz the microwave absorption considerably depending on whether the water temperature is below or above 0° C., Below 0° C. ice forms which is highly transparent to microwaves, while at a temperature above 0° C. water has a very strong microwave absorption. This effect is caused by variations of the dielectric losses of water as a function of temperature.

French patent No. FR 2,571,830 describes a microwave oven provided with a standard load placed in the oven beside the food to be processed. The standard load absorbs microwave energy in accordance with a distribution which depends on the standard load and on the load of food to be processed. Thus, from the rise in temperature of the standard load it is possible to derive the quantity of food present in the oven and to automatically determine the cooking time. According to said patent the rate of heating of the standard load is substantially independent of the temperature of the detector.

Although a defrosting operation is mentioned therein said patent does not reveal any means for attending the critical transition from a frozen condition to a defrosted condition of the food to be processed, or how the defrosting can be controlled.

SUMMARY OF THE INVENTION

The technical problem to be solved by the invention is therefore to follow the variation in temperature of the product to be defrosted and to detect the end of the defrosting cycle, in order to proceed to a subsequent operation by means of a cheap detector having a high detection sensitivity to temperature variations.

This technical problem is solved in that the detector controls the defrosting operation of a product to be defrosted and for this purpose the material which absorbs the microwave energy is deposited in a layer on a carrier which is arranged behind the product to be defrosted in order to ensure that a large part of the detector area can only receive microwaves through the product and is not exposed directly to the microwaves emitted by the microwave source.

If two loads are simultaneously placed in a microwave oven the total power available will be distributed between the two loads in such a way that the temperature of each load is raised by a value which depends on its absorption. Thus, if the thermodynamic characteristics of one of the loads are known, the temperature variation of said reference load will depend on the presence and the thermodynamic state of the product to be defrosted and it will be possible to derive the state of the product to be defrosted from said variation. The defrosting detector constitutes said reference load. It should have welldefined and stable thermodynamic parameters.

In the situation envisaged by the invention the other substance consists mainly of ice. This is the product to be defrosted. Its absorption coefficient is very small. Therefore, the microwave energy is absorbed mainly by the detector itself, which is constructed to have a suitable absorption coefficient. The transition of the state of the product from ice to water results in the product progressively absorbing more and more microwave energy, i.e. being heated increasingly. The energy absorbed by the detector decreases progressively. Thus, the variation of the detector temperature will follow the variation in temperature of the product being defrosted and placed in its proximity.

Since the product to be defrosted generally consists largely of ice, the material of the defrosting detector should have dielectric losses higher than those of ice.

The material is deposited in a layer on a carrier, for example on a wall of the oven cavity. The material of the carrier may be transparent to microwaves and may be selected, for example, from the following materials: glass ceramics, aluminium, glass. The material may be situated in a casing which is transparent to microwaves.

The detector is arranged behind the product to be defrosted in order to ensure that it is not exposed directly to the microwave source. In this way two heating mechanisms can be put to work, which ensures a high detection sensitivity to temperature variations of the detector.

The first mechanism is the transfer of microwave energy to the detector through the product to be defrosted while the latter changes from the frozen state to the defrosted state.

In particular, if the product which by nature contains much water, is taken from the freezer at a temperature of approximately −20° C. its microwave absorption will be only very low. Consequently, all the power available in the microwave oven will be utilised to raise the temperature of the detector. As soon as the process of defrosting the product sets in, the product will absorb more and more microwave power so that the temperature of the detector will rise less rapidly.

The second mechanism is that the product to be defrosted absorbs more and more of the microwaves traversing the product in the direction of the detector. This is caused by the fact that the product to be defrosted becomes increasingly opaque to microwaves.

The slope of the curve representing the temperature rise of the detector as a function of time will therefore decrease constantly as the ice melts until all the ice present in the product to be defrosted has been transformed completely to water. Consequently the temperature rise of the detector will be a linear function of time during the period in which the thermodynamic characteristics of the product do not vary.

The detector is arranged behind the product to be defrosted, in the direction from the microwave source to the such product. The microwave source may be arranged on any of the walls of the oven cavity. The detector is then arranged near or is secured to the facing wall. In particular, if the microwave source is arranged in the upper part of the cavity, the detector will be arranged near the oven tray, suitably underneath said tray. The detector may be in contact with the oven tray. If the detector material is disposed in a casing, this casing is secured to the upper side of the oven tray. However, preferably the absorbing detector material is placed in direct contact with the oven tray. The oven tray may be made wholly or partly of a material which is transparent to microwaves, for example a glass-ceramic material. The detector material may be an ink applied by screen-process printing. The ink may be a resistive ink. In that case the deposited ink can form an electrical resistance which varies with the rise in temperature caused by the microwave absorption and which also constitutes the measuring element for determining the temperature variations.

It is also possible to measure the temperature variation using conventional techniques by means of a shielded probe.

In order to determine the variations in the temperature of the detector the temperature variation measuring element supplies an electric signal whose variations as a function of time are determined by means of a computing control device. These variations are processed by the computing control device, which compares the slopes of said variations as a function of time at successive instants and acts to control the operating cycle of the microwave source when two successive values of said slope are substantially equal.

The presence of the detector makes the power-selection switch of the oven redundant. Indeed it is adequate to operate the oven initially with a low microwave power repetition rate and to measure the slope of the curve representing the temperature rise of the detector as a function of time. As this slope decreases the product in the oven is still partially frozen. When said slope becomes moderate the oven can automatically increase its microwave power repetition rate because the product in the oven has been defrosted and merely has to be re-heated.

The criterion to stop the defrosting function should allow for the fact that if the product to be defrosted consists substantially of ice the slope of the curve representing the variations in temperature of the detector as a function of time may be constant and thus resemble that of a product already defrosted. The distinction is then made on the basis of the value of said slope:

if it is substantially equal to that of the detector alone, the product in the oven is frozen, if it is substantially smaller, the product in the oven has consequently been defrosted.

By means of a substance deposited in layers a detector having a small thermal lag and a high detection sensitivity can be obtained. It is possible to use a plurality of detectors having different thermodynamic characteristics.

BRIEF DESCRIPTION OF THE DRAWINGS

Embodiments of the invention will now be described in more detail, by way of non-limitative example, with reference to the accompanying drawings in which.

DESCRIPTION OF THE PREFERRED EMBODIMENTS

Figure 1:
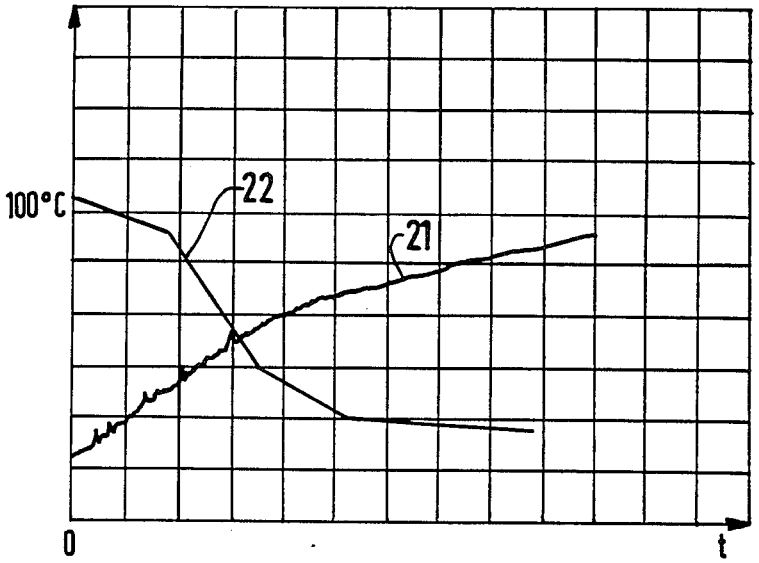
FIG. 1 shows curves representing the temperature and temperature variations as a function of time for a detector arranged behind a product to be defrosted and consisting of a mass of ice while the mass of ice is being defrosted.

FIG. 1 represents the temperature variations 21 as a function of time for a detector during defrosting of a mass of 200 grammes of ice. The slope of the curve 21 is represented by the curve 22. It is found that at the beginning said slope has a large value which initially decreases slowly and subsequently rather rapidly until it finally stabilises. This stabilisation is utilised in order to detect the end of the defrosting cycle by means of the computing control device.

Figure 2A:
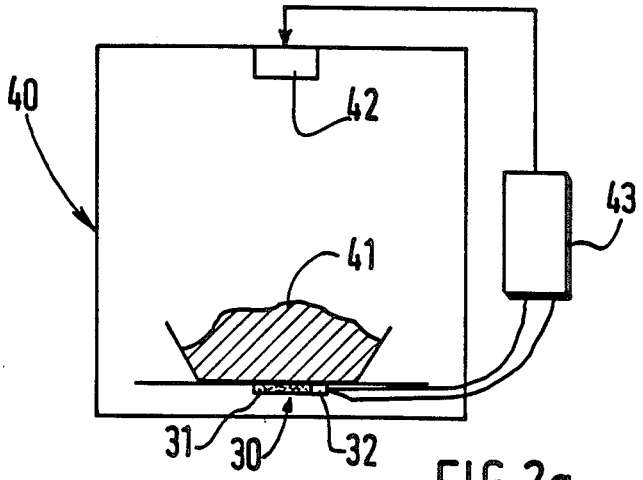
FIG. 2*a* and FIG. 2*b* diagrammatically show a microwave oven employing different detectors.

FIG. 2*a* shows a microwave oven 40 comprising a defrosting detector 30 provided with a microwave absorbent material 31. The detector is placed underneath the product 41 to be defrosted. A microwave source 42 emits microwaves towards the detector 30. When the product 41 is in its frozen state it allows the passage of microwaves which reach the detector through the product to be defrosted. In its defrosted state the product will capture the waves. Preferably the detector 30 comprises an ink applied to the oven tray by screen-process printing. The temperature measuring element 32 comprises a shielded probe. However, it may also comprise the detector shown in FIG. 2. The result of the temperature measurement of the detector 30 is transmitted to a computing and control device 43, which influences the operation of the microwave oven.

Figure 2B:
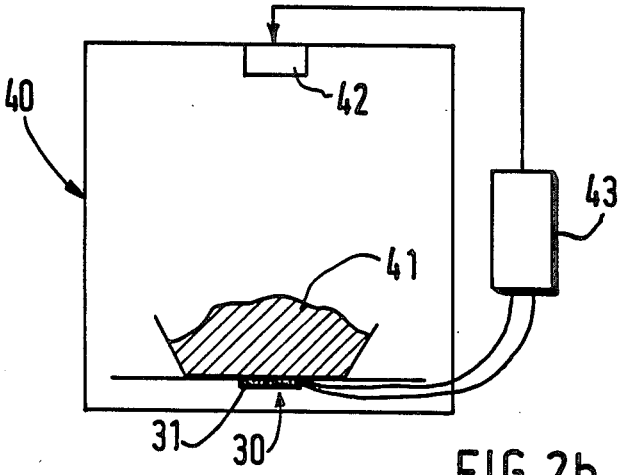

In FIG. 2*b* the detector comprises a temperature dependent resistor formed by depositing a resistive ink on the oven tray by screenprocess printing.

Figure 4:
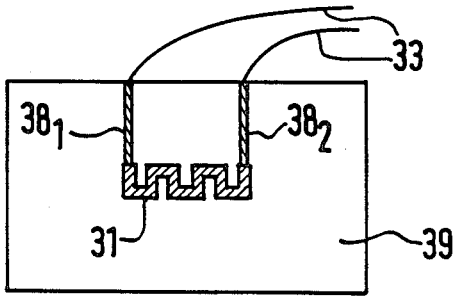
FIG. 4 shows a diagram of the arrangement of the resistance which is deposited on the oven tray by screen-process printing, together with its connecting leads.

FIG. 4 shows an example of the resistor. It constitutes both the microwave-absorbing medium and the measuring element which determines the temperature variations. The resistor is in contact with the oven tray 39. It must be arranged in such a way that it is shielded by the product to be defrosted, so that the microwaves emitted in its direction reach it through the product to be defrosted.

The resistance value is measured via the leads $\mathbf{38}_1$, $\mathbf{38}_2$. These leads can be made from a material which is not heated or which is heated only slightly by microwaves, in order to ensure that this does not affect the measurements carried out by means of the resistor 31. It is possible to use for example a resistive ink having a resistivity higher than that used for the resistor 31. The leads $\mathbf{38}_1$, $\mathbf{38}_2$ may form an integral part of the resistor 31. However, for the greater part said leads should be shielded by the product to be defrosted, in order to utilise the operating principle described in the foregoing.

The temperature-measuring element 32 (FIG. 2*a*) may comprise an infrared-radiation detector of the pyro-electric type, which determines the temperature of the detector 30 by remote measurement. The measurement signal is transferred to the computing and control device 43, which influences the microwave source 42.

Figure 3:
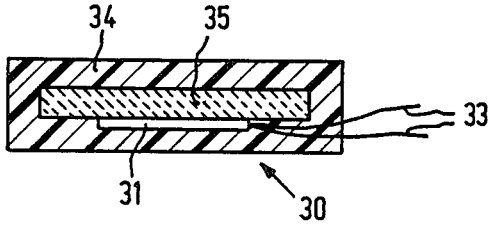
FIG. 3 diagramatically shows one of the detector types.

FIG. 3 shows an example of a defrosting detector 30. The material 31 is attached to a carrier 35 which hardly or not absorbs microwaves. The carrier 35 and the material 31 are thermally insulated by means of an insulator 34. The insulator may also constitute the casing. Preferably, the material 31 is applied by screen-process printing. It may be an ink, for example a resistive ink, intended for constructing thick-film circuits. The carrier is, for example, a glassceramic plate. The thermal insulator 34 is selected from the following materials: polystyrene, bakelite, or any other thermally insulating plastics material which is transparent to microwaves.

The element for measuring the temperature variations may comprise a shielded probe of a type known in the field of microwave ovens, whose leads 33 are shown in FIG. 3. Many resistive inks have a temperature variation coefficient which is adequate to allow the material 31 to be utilised as the measuring element. The detector shown in FIG. 3 is then very compact. The leads 33 must be shielded at the location where they can be exposed to microwave energy.

The detector shown in FIG. 3 is used when a plurality of successive defrosting operations are to be carried out. Since the heat exchange with the exterior is small the detection sensitivity will be substantially equal during each operation.

The solid material may be a ferrite, a solid which partly contains metal ions, or any other solid having such losses that a suitable heating of the detector is ensured.

Figure 5:
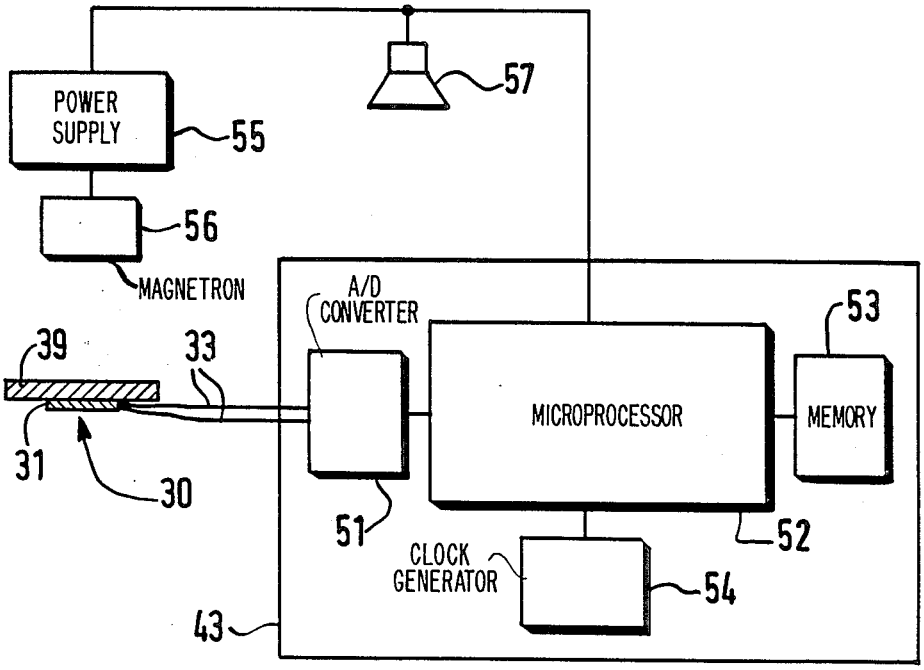
FIG. 5 shows an electric circuit arrangement for controlling the operation of the microwave source in response to measurements effected by means of the detectors.

FIG. 5 shows an electric circuit diagram of an arrangement for controlling the operation of the microwave source in response to measurements effected on the material 31 deposited on the oven tray 39. The electric signals from the detector 30 are applied to the computing control device 43. An example of said device comprises an A/D converter 51 connected to a microprocessor 52 having a memory 53 and a clock generator 54. The microprocessor 52 determines the variations in slope of the electric signal which it receives and stores the values in the memory 53. The value at the instant t is compared with that determined at the instant t-1 and, if two consecutive values are substantially equal, the microprocessor influences the power supply 55 of the magnetron 56 constituting the microwave source. An alarm 57 can indicate the progress of the operation.

The operating principle is as follows. The temperature of the detector is converted into an electric signal, which is converted into a digital signal by means of an analog-to-digital converter. This signal is subsequently stored in a RAM and processed by the microprocessor. In the case of defrosting, processing consists of measuring the temperature at fixed time intervals and comparing the different measurement values with each other in order to determine a slope of the curve representing the rise in temperature of the detector as a function of time, and subsequently determining the variation of said slope. For example, during a complete defrosting cycle a temperature measurement may be carried out every two seconds and the rate at which the temperature rises may be measured after every 100 temperature measurements by a method such as the least-squares method. Such a measurement then yields a variation in slope as a function of time, whose characteristics may be as follows in the case of a body containing a large amount of water.

Initially the load is frozen. The rise in temperature of the detector is rapid and follows a curve which would be identical if the detector alone were present. Under these conditions the slope measured by the least-squares method is constant, being substantially a straight line parallel to the time axis.

Subsequently, the load begins to defrost. The rise in temperature of the detector is less rapid. The curve of the slope as function of time then has a negative derivative.

When the load is defrosted completely, the rise in temperature of the detector becomes again microtonic with a more moderate slope than at the beginning of the operation when no change of phase, such as boiling, occurs. This effect manifests itself as a stabilisation of the least-squares curve, which stabilised portion extends parallel to the time axis. The microprocessor recognises this new stabilisation as the end of the defrosting cycle. By means of suitable input/output interfaces the microprocessor can then turn off the microwave source and, if desired, provide an indication to the user, or start a reheating cycle.

We claim:

1. A microwave oven which provides controlled defrosting of a frozen product, comprising a microwave source and a detector arranged in the oven cavity in the proximity of such product, the detector including a material which absorbs microwave energy, the absorption of microwave energy by the detector material and by the product causing their temperatures to rise, the variations in detector temperature being measured by a temperature measuring element producing an electrical signal corresponding to such temperature; characterized in that:

said oven further comprises a computing control device connected to said temperature measuring element for determining from the variations in said electrical signal when defrosting of said product has been completed; and said absorbent material is in the form of a layer deposited on a carrier positioned behind said product in relation to the microwave source, so that most of the area of said layer is only directly exposed to microwaves emitted by the microwave source which have passed through said product.

2. A microwave oven as claimed in claim 1, characterized in that the carrier is one of the walls of the oven cavity.

3. A microwave oven as claimed in claim 1, characterized in that the carrier is transparent to microwaves.

4. A microwave oven as claimed in claim 3, characterized in that the material of the carrier is selected from the following materials: glass ceramic, aluminium, glass.

5. A microwave oven as claimed in claim 1, characterized in that the carrier is an oven tray, the microwave source being arranged in the upper part of the oven.

6. A microwave oven as claimed in claim 1, characterized in that the detector material is an ink deposited on the carrier by screenprocess printing.

7. A microwave oven as claimed in claim 6, characterized in that the ink is a resistive ink.

8. A microwave oven as claimed in claim 7, characterized in that the resistive ink constitutes a resistor whose electrical resistance varies with the rise in temperature thereof caused by microwave absorption, such resistor also constituting the measuring element which produces the electrical signal corresponding to the detector temperature.

9. A microwave oven as claimed in claim 1, characterized in that the computing control device compares the slope of the variations of said signal as a function of time at successive instants, and controls operation of the microwave oven when the values of said slope at such instants are substantially equal.

* * * * *